US007032978B2

(12) United States Patent
Baek et al.

(10) Patent No.: US 7,032,978 B2
(45) Date of Patent: Apr. 25, 2006

(54) CRUSHING METHOD USING LARGE BOREHOLES IN UNDERWATER ROCK

(76) Inventors: In Suk Baek, 101-1205 Eden Geumho Town, 680-12 Dongsam 1-dong, Yeongdo-gu, Busan, 606-807 (KR); Jong Seol Kim, 501 Jooyoung Villa, 16-3 Dongdaesin-dong 3-ga, Seo-gu, Busan, 602-812 (KR); Dae Woo Kang, 216-1702 Shingaegum LG Apt., 455 Gaegum-dong, Busanjin-gu, Busan, 614-751 (KR)

( * ) Notice: Subject to any disclaimer, the term of this patent is extended or adjusted under 35 U.S.C. 154(b) by 0 days.

(21) Appl. No.: 10/900,690

(22) Filed: Jul. 27, 2004

(65) Prior Publication Data

US 2005/0194832 A1 Sep. 8, 2005

(30) Foreign Application Priority Data

Mar. 5, 2004 (KR) ..... 10-2004-0015062

(51) Int. Cl.
*E21C 37/00* (2006.01)

(52) U.S. Cl. ..... 299/10; 299/95

(58) Field of Classification Search ..... 299/14, 299/15, 16, 95, 10

See application file for complete search history.

(56) References Cited

U.S. PATENT DOCUMENTS

| | | | | |
|---|---|---|---|---|
| 4,139,237 A | | 2/1979 | Hay | 299/94 |
| 5,087,100 A | * | 2/1992 | Bruce | 299/15 |

FOREIGN PATENT DOCUMENTS

| | | |
|---|---|---|
| CA | 2212993 | 2/1999 |
| GB | 199245 | 6/1923 |
| GB | 204544 | 10/1923 |
| GB | 222099 | 6/1925 |
| GB | 2172030 | 9/1986 |

* cited by examiner

*Primary Examiner*—John Kreck
(74) *Attorney, Agent, or Firm*—Sheridan Ross P.C.

(57) ABSTRACT

The present invention relates to a crushing method using large boreholes in an underwater rock in which plural large boreholes are drilled on the rock in a predetermined space, the drilled boreholes form plural free surfaces, and the large drop hammer gives a blow to the free surface, thus enhancing the crushing effect.

The crushing method is comprised of the following processes: plural large boreholes, of which each size is 100~300 mmφ, are arranged on the rock to be crushed, and are drilled in a depth of 1~10 m, and the free surface is reserved before the drop hammer work; a middle point between the adjoining large boreholes is set as target point; the drop hammer is lift above a position perpendicular to the target point, and is free-fallen to give a blow to the rock to be crushed; and the above processes are repeatedly operated.

10 Claims, 3 Drawing Sheets

CRUSHING METHOD USING LARGE BOREHOLES IN UNDERWATER ROCK

BACKGROUND OF THE INVENTION

1. Field of the Invention

The present invention relates to a crushing method that uses large boreholes in an underwater rock generated by a drop hammer that is suspended from a jib crane of a stone crushing ship, and particularly to a crushing method using large boreholes in an underwater rock in which plural large boreholes are drilled on the rock in a predetermined space, plural free surfaces are formed by the drilled boreholes, and the large drop hammer gives a blow to the free surface of the boreholes, thus the crushing effect is enhanced by the free surfaces of the crushed holes.

2. Description of the Prior Art

When a pier ground work for an underwater bridge structure, a sea structure construction for specific purpose, a development of a waterway for a large ship, and a berth construction for a large ship, the rock existed at the spot in an underway will be eliminated so that the spot has to be flattened, and the main construction can start.

In general, in the elimination work of a spur of a rock, a drilling is executed on the rock, and a blasting powder is loaded in the drill holes. Next the blasting work takes place. However, when a re-blasting work is not possible after the failure of the blasting, or there are structures near the blasting spot, or boulders are produced after the blasting, plural blows are given to the rock to be crushed so as to eliminate the spur of the rock.

In conventional stone crushing work using a blow, a stone crushing ship having a jib crane moves above the rock to be crushed. Anchors of the ship are dropped on the rock that is far away from the hull in a predetermined distance, and the stone crushing ship stops. A drop hammer of 5~50 tons that hangs from a hoist rope of a jib crane wound on a drum is lifted a predetermined height (15 m above the crush target point). The drop hammer falls free to crush the rock. The above process is repeated.

The crushing method using the crushing drop hammer, compared to the blasting work, has less noise, less shock-wave by the vibration and less dispersion of rubble. Therefore, the crushing method is being used where the blasting work is difficult—e.g. where the critical structure such as a gas pipe, a bridge etc. exists near the target rock in the case of a shallow area, and where the blasting fails at an existing blasting point.

However, using the conventional crushing method, since the rock to be crushed is formed as a unitary body, and the blow energy is dispersed to the whole portion of the rock, it is very difficult to break the rock with a repeating blow (e.g. more than 7 times). The crushing speed is very low, and finally it causes non-economic problem that time and investment are excessively required.

Furthermore, the target spot of the rock to be crushed is determined visually, and it is impossible to give a blow to the target spot accurately. This causes to less target effect, and non-economic problems such as an increase of speed and cost for construction process.

On the other hand, when the drilled rock in a underway is crushed by a drop hammer according to a prior art, no drilling operation occurs under 75 mmϕ of a borehole, and also the free surface formed around the boreholes has a limit range according to the borehole size. It cannot insure larger free surface than the existed borehole size.

Therefore, to crush the rock, the target blow of the drop hammer requires more than 7 times, which means the not-easy crushing work of the rock in the underwater. Non-efficient problems occur in which construction period and cost for crushing rock should increase.

SUMMARY OF THE INVENTION

To solve the non-efficient problems of the prior crushing method of the rock in the underwater rock—using the drop hammer hanging from a jib crane of the stone crushing ship, the applicant invents the following method. With this method, large boreholes are formed at the underwater rock to crush the rock. The method utilizes the invention applied by the same applicant. The invention deals with a boring machine in underwater rock using differential global positioning system receiver and boring method using the same.

It is an object of the present invention to provide the crushing method using large boreholes in the underwater rock, in which plural large boreholes are drilled on the rock in a predetermined space, and the free surface is reserved before the drop hammer work. The large drop hammer gives a blow to the free surface, and the tensile cracks are generated an area between the free surfaces of the crushed holes. This enhances the crushing effect.

It is a further object of the present invention to provide the crushing method using large boreholes in the underwater rock, in which the present invention brings the technology of satellite navigation for orientation of the accurate position (i.e. Differential Global Positioning System) to the crushing work in the underwater rock. The target point of the rock to be crushed is accurately detected, and the blow is given, thereby maximizing the efficiency of the shock energy.

In order to accomplish those and these objects, the present invention has characteristic in which; crushing method using large boreholes in an underwater rock in which a stone crushing ship that provides a jib crane moves to a position above a rock to be crushed, the stone crushing ship is stopped by dropping an anchor on an underwater rock which is distanced in a predetermined length from the hull, a drop hammer that is hang from a hoist rope of the jib crane wounded on a drum is lift in a predetermined height, the drop hammer is free-fallen to give a blow to the rock to be crushed, the crushing method is comprised of the following processes: plural large boreholes, of which each size is 100~300 mmϕ, are arranged on the rock to be crushed, and are drilled in a depth of 1~10 m, and the free surface is reserved before the drop hammer work; a middle point between the adjoining large boreholes is set as target point to be crushed; the drop hammer is lift above a position perpendicular to the target point to be crushed, and is free-fallen to give a blow to the rock to be crushed; and the above processes are repeatedly operated.

Further, it has another characteristic in that the large boreholes are firstly drilled in at a predetermined distance; a surface layer of the rock to be crushed is crushed at a predetermined depth by a drop hammer operation; the crushing is ceased and the second or more drilling work is operated at between the first drilled large boreholes; many free surface according to the large boreholes is secured; and the drop hammer operation against the deep layer is provided.

Further, it has another characteristic in that a differential global positioning system (DGPS) receiver is installed at a predetermined point of a boom of the jib crane that vertically lifts the drop hammer, the DGPS receiver collects a position information from plural satellites and a reference station;

and the target point to be crusted is accurately perceived using the DGPS receiver; and the drop hammer is moved above a position perpendicular to the target point to be crushed, is lifted, and is free-fallen to give a blow to the rock to be crushed.

According to the present invention's characteristics, plural large boreholes forms plural free surfaces around the rock to be crushed, and fine cracks are formed between boreholes by the blow of the drop hammer. Additional free surfaces are built up above the existed free surface, and the blow is given to get the second crushing. The rock can be crushed in 3~5 times according to the present invention, while the same rock had to be crushed in more than 7 times according to the prior art.

Therefore, the work speed of the stone crushing is very fast according to the present invention, which brings the outstanding effect in the whole case—the ability of construction and the economical efficiency.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
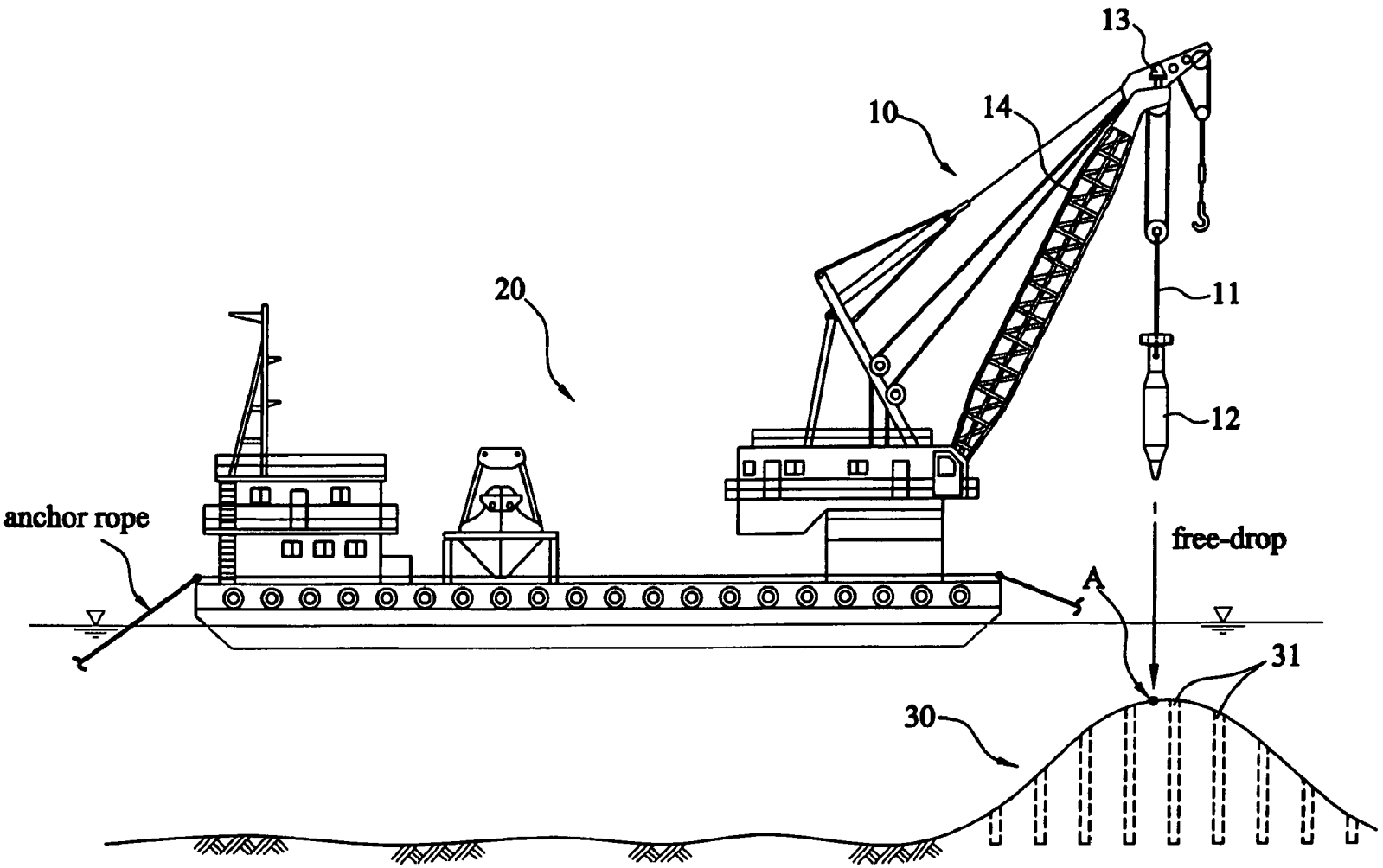
FIG. 1 is a side view showing that a preventive stone crushing ship that moves towards the position of a rock that will be crushed, then will be anchored.

Reference should now be made to the drawings, in which the same reference numerals are used throughout the different drawings to designate the same or similar components.

Figure 2:
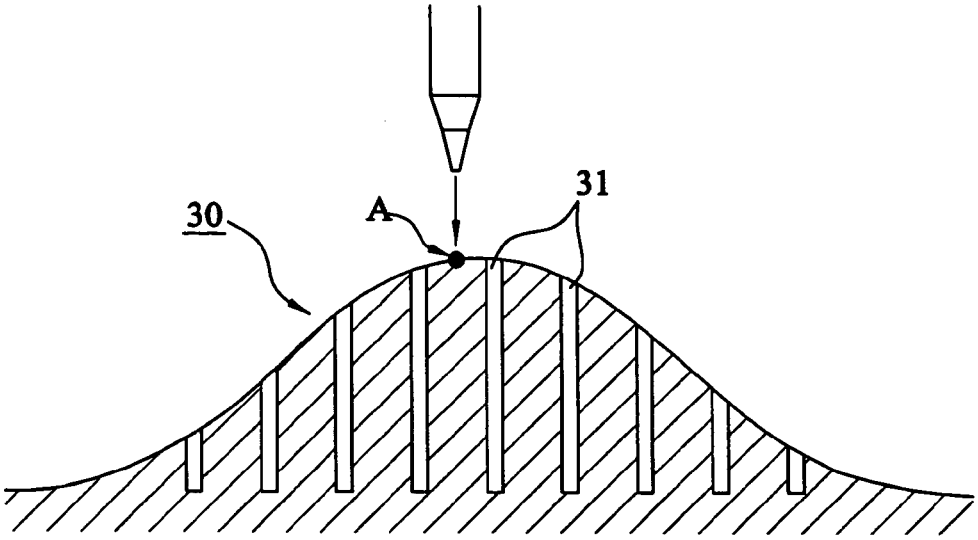
FIG. 2 is a cross section of the rock having large boreholes according to the preventive crushing method in the underwater rock.
Figure 3:
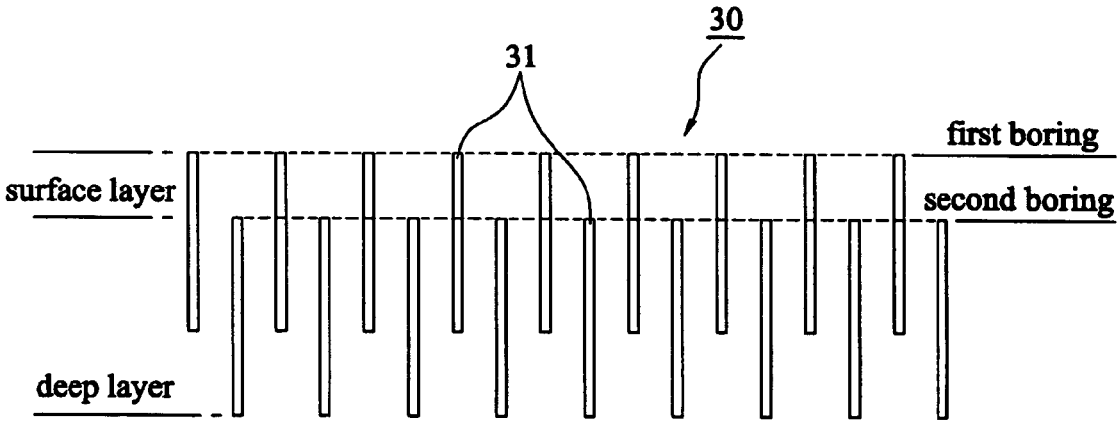
FIG. 3 is an execution example to operate the boring in a primary and secondary steps according the present invention.
Figure 4:
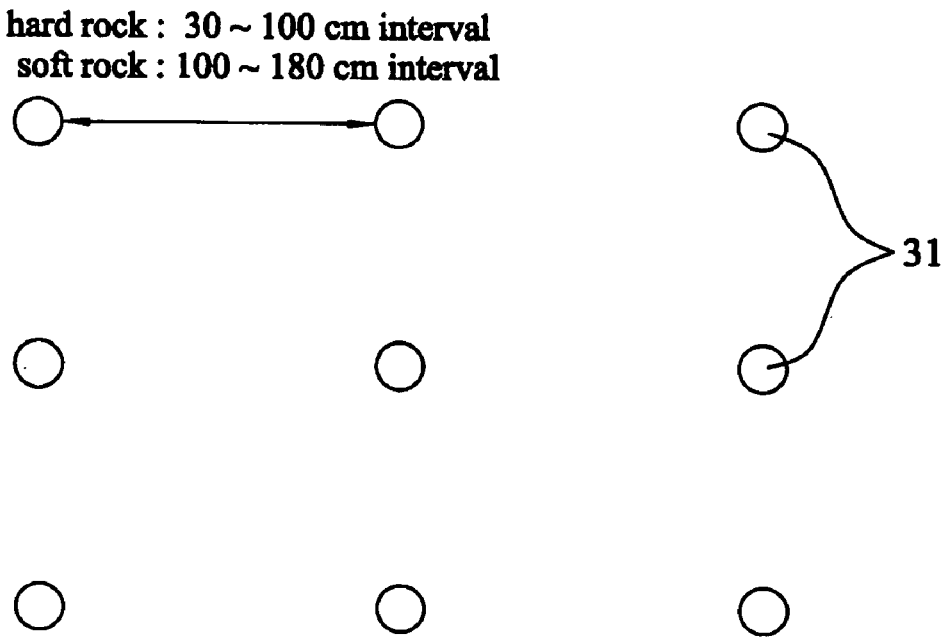
FIG. 4 is a plan view showing an arrangement of large boreholes according to the present invention.
Figure 5:
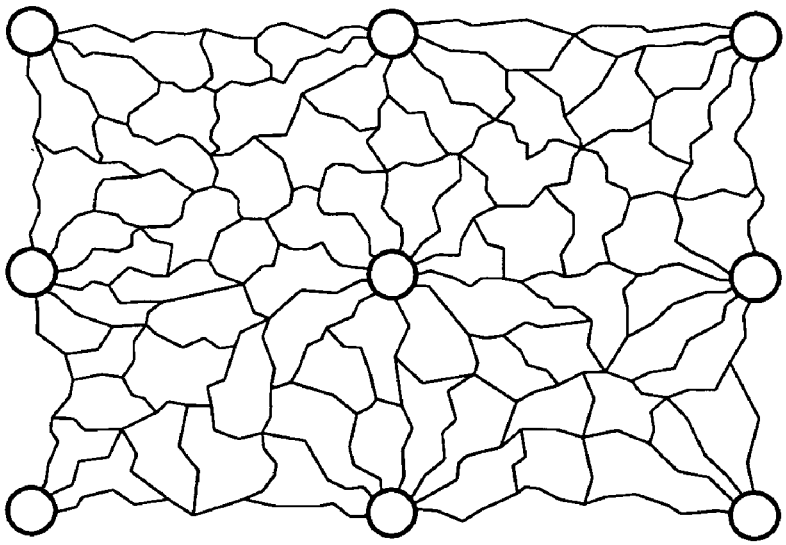
FIG. 5 is a view illustrating a crack condition of the rock given a blow by a drop hammer according to the present invention.

FIG. 1 is a side view showing that a preventive stone crushing ship that moves towards the position of a rock that will be crushed, then will be anchored, FIG. 2 is a cross section of the rock having large boreholes according to the preventive crushing method in the underwater rock, FIG. 3 is an execution example to operate the boring in a primary and secondary steps according the present invention, FIG. 4 is a plan view showing an arrangement of large boreholes according to the present invention, and FIG. 5 is a view illustrating a crack condition of the rock given a blow by a drop hammer according to the present invention.

As shown in FIGS., the preventive crushing method executes a boring work in advance. A boring machine for large borehole provided at the inner center of a barge—that is already invented by the applicant—makes large boreholes 31 in a predetermined distance and in plural array on the rock 30 to be crushed in 100~300 mmϕ, preferably 105 mmϕ, and in 1~10 m depth.

In the prior art, the borehole under 75 mmϕ could only be executed since the barge must execute at the inclined and offset position with the effect of the external force such as the wave force. However, according to the boring machine and method already applied by the applicant, the boring machine is provided at the inside of the barge, which can make a boring work without the effect of the external force. It is possible to build up the large borehole of 100~300 mmϕ. Therefore, if large boreholes are formed, the borehole can obtain many free surfaces than the conventional borehole owing to the relative increased number of boreholes. Thus, it leads the easy crushing of the rock.

Therefore, the free surface in the bore status is formed as the free surface inside the borehole and the free surface above the borehole. The size of the free surface is largely dependent on the size of the borehole. The present invention has the borehole size of 100~300 mmϕ, and it obtains the wide free surface and then the blow work is executed, thus easily accomplishing the crushing in underwater rock.

As in FIGS. 2 and 4 shown in the arrangement intervals of the large boreholes, the large boreholes 31 are densely arranged in 30~100 cm if the rock to be crushed is a hard rock, while it is desirable that the large boreholes 31 are arranged in 100~180 cm which is relatively longer than the hard rock if the rock to be crushed is a soft rock.

When the crushing effect of the rock increases with a low strike frequency, the drop hammer is dropped on the area between the holes, considering the enlargement of the size of the free surface by the large borehole, the hardness of the underwater rock, and the width (55~118 cm) of the lower portion of the drop hammer that is struck on the rock.

When the interval is set under 30 cm in case of the hard rock, or under 100 cm in case of the soft rock, the number of strikes at the same position to form the crack is low, but the whole frequency of the strike against the rock to be crushed must be increased, and it causes slow crushing speed. While, when the intervals is set above 100 cm in case of the hard rock or above 180 cm in case of the soft rock, the number of strikes at the same position to form the crack must be increased owing to the hard formation of the crack, and it causes problems of crushing efficiency.

After the borehole work is completed at a predetermined interval, as shown in FIG. 1, a stone crushing ship 20 providing a jib crane 10 moves to a position above a rock 30 that will be crushed with large bore hole 31. The stone crushing ship 20 is stopped by dropping an anchor on the underwater rock which is distanced in a predetermined length from the hull.

The jib crane 10 is a crane that has a boom 14 protruded on the slant from a hinge point of the stone crushing ship 20. It revolves on its hinge point. The slant angle of the boom is 50~65°, and the crushing work is operated within the range of the angle. One end of the hoist rope 11 is wounded on a hoist drum (not shown) that is installed inside the engine room. The other end the hoist rope 11 is extended along the top of the boom and is connected to the suspending drop hammer 12. Furthermore, a differential global positioning system (DGPS) receiver 13 is installed at the top end of the boom 14 of the jib crane that vertically lifts the drop hammer. The DGPS receiver collects position information from plural satellites and a reference station.

The stone crushing ship is stopped, and a middle point between the adjoining large boreholes 31 is set as the target point to be crushed. The target point A to be crusted is accurately perceived using the DGPS receiver 13 that is installed at the top end of the boom 14 of the jib crane 10. The boom 14 of the jib crane 10 moves above the target point and thus the drop hammer is lifted above the position perpendicular to the target point to be crushed.

The target point of the underwater rock is known using the DGPS receiver 13, that is, the DGPS (Differential Global Positioning System) position detecting apparatus. The DGPS is a position detecting apparatus by which the satellite signal is received from a satellite and a compensation signal is received from a DGPS reference station that is installed at the already known position of the land. A position of a ship can accurately be detected even in the open sea. The DGPS is a lightweight apparatus, which is composed of an antenna receiving the satellite signal, a RF (radio frequency) unit extracting the desirable signal from the satellite signal, a computing unit processing the desirable signal, and a user interface unit.

The apparatus is a modular GPS system that can measure the position far from the GPS satellite and the reference station. It can operate continuously for 24 hours. The location information with the high accuracy (error range 2 cm) can be get through the process of the observation in Real Time Kinematics (RTK) in the quick initialization and the low power. The well-known conventional art is diverted to the DGPS of the prevent invention, and therefore needs to no further description here.

Using the above process, the drop hammer 12 moves above the middle point—target point to be crushed 'A'—between the large boreholes 31. The drum installed in an engine room runs to wind the hoist rope 11. The drop hammer 12 lifts up from the target point to be crushed 'A' about 15 m. The hoist rope 11 is bound to maintain the drop hammer 12 at a steady position.

Next, the bound state of the hoist rope 11 wound on the hoist drum is released. The drop hammer is free-dropped by its unladen weight. The drop hammer 12 gives a blow to the target point to be crushed 'A' of the rock 30, thus starting the crushing work of the rock.

The present invention is a method where the drop hammer is suspended, stopped, and free-fallen above the target point to be crushed 'A'. The blow to the target point comes to operation about 3~5 times. The drop hammer 12 moves to the next target point. The above blow work is repeatedly operated, thus crushing the rock area.

As shown in FIG. 5, plural large boreholes are provided in a predetermined interval, and it builds up plural free surfaces around the rock to be crushed. Fine cracks are formed between the large boreholes provided by an impact of the large drop hammer. The crushing work utilizes the free surfaces formed by the large boreholes 31, and it gives effectiveness to the crush in the underwater rock. Furthermore, the debris of the crushed rock is put into a bucket so that the bed of the sea can be flattened.

Meanwhile, the large boreholes 31 are drilled in a predetermined interval as shown in FIG. 3. The surface layer of the rock 30 is crushed in a proper depth by the drop hammer blow. The blow work is ceased, and the second or more drilling work is operated between the first drilled large boreholes 31. The many free surfaces according to the large boreholes are secured, and the drop hammer operation against the deep layer is provided step by step.

As described above, since series of the large borehole work is executed in a step, the depth of the large boreholes is deep and many free surfaces are secured, to improve the efficiency of the crushing work.

According to the crushing method using large boreholes in the underwater rock, plural large boreholes are drilled on the rock in a predetermined space, and the free surface is reserved before the drop hammer work. The large drop hammer gives a blow to the free surface, and the tensile cracks are generated an area between the free surfaces of the crushed holes. This enhances the crushing effect.

In addition, the present invention brings the technology of satellite navigation for orientation of the accurate position (i.e. Differential Global Positioning System) to the crushing work in the underwater rock. The target point of the rock to be crushed is accurately detected, and the blow is given, thereby maximizing the efficiency of the shock energy.

Therefore, according to the present invention, the underwater rock placed at an area that is difficult to blast can be efficiently crushed. The speed of crushing work can be increased to deduce the working period. The underwater rock is crushed and reduces cost.

What is claimed is:

1. A rock crushing method, comprising:

arranging a plurality of large boreholes, each about 100 to 300 mm in diameter that are drilled to a depth of about 1 to 10 m, on a rock to be crushed and of which a free surface is defined that will receive the drop hammer;

setting a target point between adjoining large boreholes of the plurality of large boreholes;

lifting the drop hammer to a position generally perpendicular to the target point; and dropping the drop hammer thereby impacting the rock to be crushed.

2. The method according to claim 1, wherein each of the large boreholes of the plurality thereof are distanced about 30 to 100 cm from each other when the rock to be crushed is a hard rock.

3. The method according to claim 1, wherein each of the large boreholes of the plurality thereof are distanced 100 to 180 cm from each other when the rock to be crushed is a soft rock.

4. The method according to claim 1, further comprising:

crushing the free surface of the rock to be crushed to a predetermined depth;

arranging at least a second plurality of large boreholes between the plurality of large drill holes, thereby defining a second free surface;

setting a second target point based on the second plurality of large boreholes;

lifting the drop hammer to a position generally perpendicular to the second target point; and dropping the hammer onto the second free surface.

5. The method according to claim 1, further comprising:

installing a differential global positioning system (DGPS) receiver at a predetermined point on a boom of a jib crane that lifts the drop hammer;

collecting a position information from at least one of a plurality of satellites and a reference station;

accurately perceiving the target point using the DGPS receiver; and moving the drop hammer to a position generally perpendicular to the target point prior to lifting the drop hammer and dropping the drop hammer.

6. A method of crushing a rock, comprising:

drilling a plurality of large boreholes in the rock;

targeting a point between adjoining boreholes;

lifting a drop hammer over the point; and dropping the drop hammer onto the point.

7. The method according to claim 6, wherein each of the large boreholes of the plurality thereof are distanced about 30 to 100 cm from each other when the rock is hard.

8. The method according to claim 6, wherein each of the large boreholes of the plurality thereof are distanced 100 to 180 cm from each other when the rock is soft.

9. The method according to claim 6, further comprising:

crushing the rock to a predetermined depth;

drilling at least a second plurality of large boreholes between the plurality of large drill holes;

setting a second target point based on the second plurality of large boreholes;

lifting the drop hammer to a position generally perpendicular to the second target point; and dropping the hammer onto the second target.

10. The method according to claim 6, further comprising:

installing a differential global positioning system (DGPS) receiver at a predetermined point on a boom of a jib crane that lifts the drop hammer;

collecting a position information from at least one of a plurality of satellites and a reference station;

accurately perceiving the target point using the DGPS receiver; and moving the drop hammer to a position generally perpendicular to the target point prior to lifting the drop hammer and dropping the drop hammer.

* * * * *